US009333140B2

(12) United States Patent
Bharadwaj et al.

(10) Patent No.: US 9,333,140 B2
(45) Date of Patent: May 10, 2016

(54) BED APPARATUS HAVING MOVABLE HEATER ASSEMBLY

(75) Inventors: Sanjay Bharadwaj, Bangalore (IN); Roopesh Edavana, Bangalore (IN); Samik Das, Bangalore (IN)

(73) Assignee: Koninklijke Philips N.V., Eindhoven (NL)

( * ) Notice: Subject to any disclaimer, the term of this patent is extended or adjusted under 35 U.S.C. 154(b) by 245 days.

(21) Appl. No.: 13/984,043

(22) PCT Filed: Feb. 14, 2012

(86) PCT No.: PCT/IB2012/050651

§ 371 (c)(1), (2), (4) Date: Aug. 7, 2013

(87) PCT Pub. No.: WO2012/110941

PCT Pub. Date: Aug. 23, 2012

(65) Prior Publication Data

US 2013/0312179 A1 Nov. 28, 2013

Related U.S. Application Data

(60) Provisional application No. 61/442,408, filed on Feb. 14, 2011.

(51) Int. Cl.
*A61G 11/00* (2006.01)

(52) U.S. Cl.
CPC ..... *A61G 11/00* (2013.01); *A61G 11/008* (2013.01)

(58) Field of Classification Search
CPC ..... A61G 7/018; A61G 7/015; A61G 7/012; A61G 7/005; A61G 13/02; A61G 13/04; A61G 13/06; A61G 13/08; A61G 11/00; A61G 11/001; A61G 11/002; A61G 11/003; A61G 11/008; A61G 2210/90; A47D 7/00; A47D 9/00; A47C 21/04; A47C 21/048
USPC ..... 5/421, 284, 655, 603, 610, 600; 600/22
See application file for complete search history.

(56) References Cited

U.S. PATENT DOCUMENTS 3,240,935 A * 3/1966 Dougall ..... A61B 6/04 378/209
4,628,553 A 12/1986 Buttitta
4,809,677 A 3/1989 Mackin et al.
5,707,006 A 1/1998 Skulic (Continued)

FOREIGN PATENT DOCUMENTS

EP 0308093 A2 3/1989
EP 0711537 A1 5/1996

(Continued)

*Primary Examiner* — Robert G Santos

(57) ABSTRACT

An improved bed apparatus (4) includes a bed (12) and a movable heater assembly (16). The bed (72) is movably disposed on a support (8), and the heater assembly (76) is movable to enable alignment between the bed (72) and the heater assembly (76) to promote uniformity of irradiance on a patient situated on the bed (72). In an embodiment, the bed (72) and heater assembly (76) are movable together to maintain alignment between the bed (72) and the heater assembly (76). In another embodiment, the bed (72) and the heater assembly (76) are independent, but one or more indicators (244, 254) are provided to enable manual alignment between the bed (72) and the heater assembly (76).

12 Claims, 9 Drawing Sheets

(56) References Cited

U.S. PATENT DOCUMENTS

| | | | | |
|---|---|---|---|---|
| 5,830,123 | A * | 11/1998 | Franz | A61N 5/06 600/22 |
| 6,082,693 | A | 7/2000 | Benson et al. | |
| 6,245,010 | B1 | 6/2001 | Jones | |
| 6,666,815 | B2 * | 12/2003 | Costanzo | A61G 11/00 600/22 |
| 6,669,625 | B2 * | 12/2003 | Costanzo | A61G 11/00 600/22 |
| 6,880,188 | B1 | 4/2005 | Schmidt et al. | |
| 7,530,942 | B1 | 5/2009 | Diab | |
| 8,419,610 | B2 * | 4/2013 | Matsubara | A61G 11/00 236/2 |
| 2002/0072649 | A1 * | 6/2002 | Costanzo | A61G 11/00 600/22 |
| 2002/0091297 | A1 | 7/2002 | Falk | |
| 2003/0045773 | A1 * | 3/2003 | Costanzo | A61G 11/00 600/22 |
| 2004/0062288 | A1 | 4/2004 | Falk | |
| 2007/0135675 | A1 | 6/2007 | MacKin et al. | |
| 2010/0081859 | A1 | 4/2010 | Matsubara et al. | |
| 2010/0286471 | A1 | 11/2010 | Matsubara et al. | |
| 2013/0312179 | A1 * | 11/2013 | Bharadwaj | A61G 11/008 5/421 |
| 2015/0038773 | A1 * | 2/2015 | Hampe | A61G 11/001 600/22 |
| 2015/0065787 | A1 * | 3/2015 | Bohnen | A61G 11/00 600/22 |
| 2015/0328074 | A1 * | 11/2015 | Edavana | A61G 11/008 5/603 |

FOREIGN PATENT DOCUMENTS

| | | | |
|---|---|---|---|
| EP | 0753983 | A2 | 1/1997 |
| EP | 0790050 | A2 | 8/1997 |
| EP | 0811363 | A2 | 12/1997 |
| EP | 0968698 | A2 | 1/2000 |
| EP | 1060727 | A1 | 12/2000 |
| EP | 1124169 | A2 | 8/2001 |
| EP | 1124403 | A2 | 8/2001 |
| FR | 2891136 | A1 | 3/2007 |
| WO | 9848757 | | 11/1998 |
| WO | 0180804 | A2 | 11/2001 |
| WO | 2009073355 | A1 | 6/2009 |
| WO | 2009073444 | A1 | 6/2009 |

* cited by examiner

BED APPARATUS HAVING MOVABLE HEATER ASSEMBLY

The disclosed and claimed concept pertains generally to infant beds and, more particularly, to an infant bed having a movable heater assembly.

As is generally understood in the relevant art, some beds, especially those for use by infants in hospitals and other medical settings, include both a bed and a heater of some type. Some heaters are of an elongated radiant configuration that generates radiant heat and projects it in a downward direction toward an upper surface of the bed to warm the infant.

As is generally understood, the ability for a newborn infant to maintain and regulate its body temperature is key for survival and growth. Infants who are born prematurely or at a low birth weight or who need medical procedures that require them to remain unclothed struggle to maintain body temperature. Calories that are expended in the maintenance of body temperature cannot otherwise be used for weight gain, which is undesirable.

Radiant warmers used in such beds typically generate radiation in the medium wave infrared spectrum. Irradiance and temperature of such warmers are typically the subject of standards that depend upon the location of use of the bed.

It is also known that certain clinical procedures require the infant to be positioned in a head-up or a feet-up inclined position, and thus the bed may be inclined at an angle of up to about 20° with respect to horizontal. Irradiance from a radiation source is known to fall with the square of the distance from the source. Thus, the tilting of such a bed results in a portion of the infant being relatively closer to the heater and thus receiving a relatively greater level of irradiance, and another portion of the infant being relatively farther away from the heat source and thus receiving a relatively lower level of irradiance. Such differences in irradiance can result in one part of the infant being undesirably hot and another part being undesirably cool. It thus would be desirable to provide an improved bed apparatus that meets these and other shortcomings known in the relevant art.

Accordingly, an improved bed apparatus includes a bed and a movable heater assembly. The bed is movably disposed on a support, and the heater assembly is movable to enable alignment between the bed and the heater assembly to promote uniformity of irradiance on a patient situated on the bed. In an embodiment, the bed and heater assembly are movable together to maintain alignment between the bed and the heater assembly. In another embodiment, the bed and the heater assembly are independent, but one or more indicators are provided to enable manual alignment between the bed and the heater assembly.

An aspect of the disclosed and claimed concept is to provide an improved bed apparatus.

Another aspect of the disclosed and claimed concept is to provide an improved bed apparatus having a movable heater assembly.

Another aspect of the disclosed and claimed concept is to provide an improved bed apparatus having a movable heater assembly that promotes uniformity of heating of a patient situated on the bed.

Accordingly, aspects of the disclosed and claimed concept are provided by an improved bed apparatus, the general nature of which can be stated as including a support, a bed disposed on the support and movable about a pivot axis among a plurality of bed positions, and a radiant heater assembly movable about the pivot axis among a plurality of heater positions, the radiant heater assembly in a first heater position being oriented to face toward the bed in a first bed position, the radiant heater assembly in a second heater position being oriented to face toward the bed in a second bed position.

A further understanding of the disclosed and claimed concept can be gained from the following Detailed Description of Exemplary Embodiments when read in conjunction with the accompanying drawings in which:

Similar numerals refer to similar parts throughout the specification.

Figure 1:
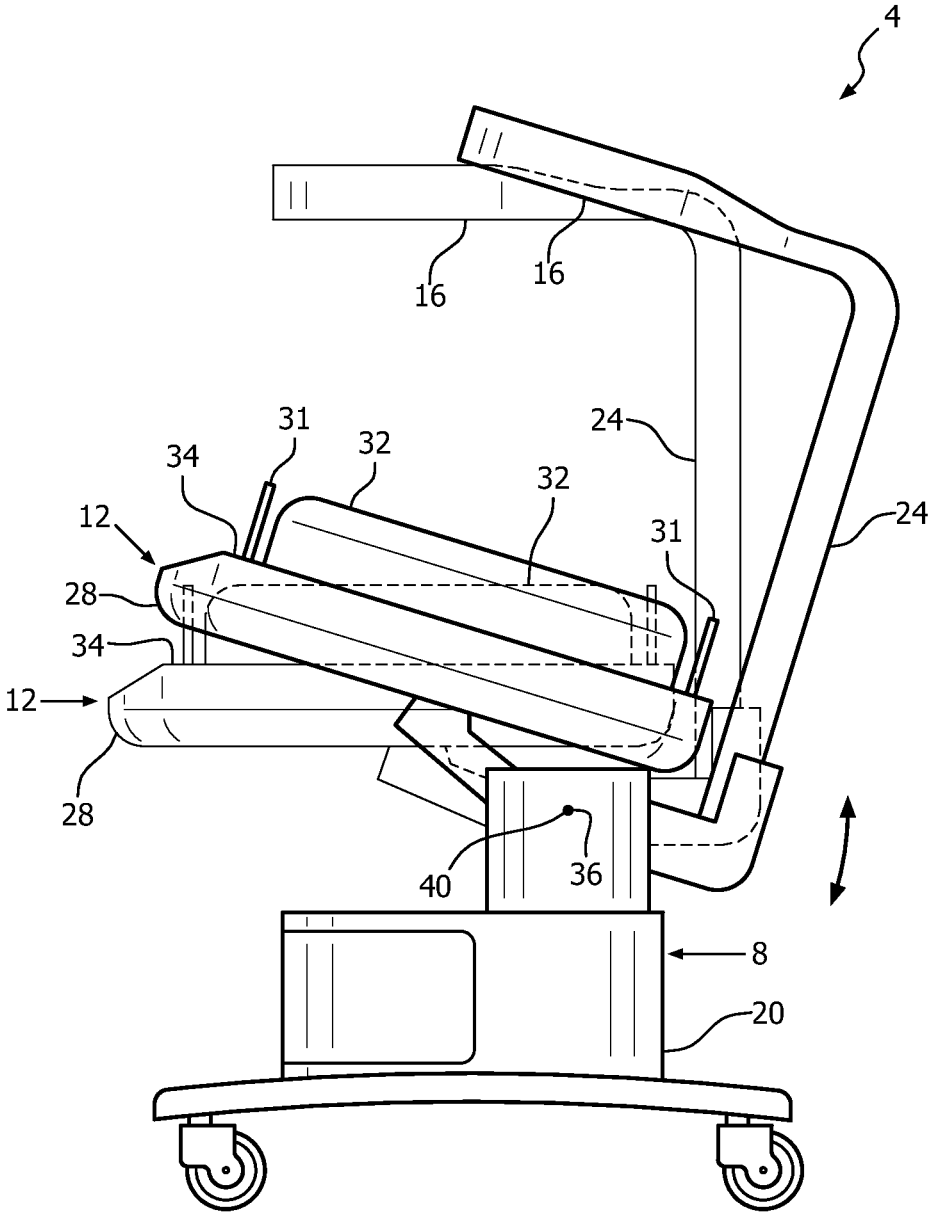
FIG. 1 is a diagrammatic view of an improved bed apparatus in accordance with an embodiment of the disclosed and claimed concept.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

FIG. 1 schematically illustrates an exemplary embodiment of an improved bed apparatus 4 according to the principles of the disclosed and claimed concept. The apparatus 4 includes a support 8, a bed 12 disposed on support 8, and a radiant heater assembly 16 disposed on support 8. Bed 12 is movable among a plurality of bed positions. Advantageously, radiant heater assembly 16 is movable among a plurality of heater positions in order to maintain alignment between radiant heater assembly 16 and bed 12, which promotes uniform warming of a patient (not expressly depicted herein) situated on bed 12.

As can be understood from FIG. 1, support 8 includes a base 20 and a strut 24. Base 20 typically is configured to be situated on a structural element such as a floor and thus may be configured to include rollable casters, although such casters are not necessary, and it is expressly noted that base 20 could instead be affixed to a wall or other structure, by way of example. Strut 24 in the embodiment of FIG. 1 is disposed on base 20 and is movable with respect to base 20.

As can further be understood from FIG. 1, bed 12 can be described as comprising a platform 28, a pair of side guards 31, and a pair of end guards 32. Side guards 31 and end guards 32 are formed of a rigid materials such as an acrylic and are situated peripherally about platform 28 to retain the patient on platform 28 as bed 12 is moved among the various bed positions. Platform 28 includes a generally planar platform surface 34 upon which the patient would be disposed. It is noted that bed 12 might further include a mattress that would likely be situated on platform surface 34 upon which the patient would be disposed.

In accordance with the disclosed and claimed concept, bed 12 is movable with respect to base 20. In particular, the embodiment depicted generally in FIG. 1 includes bed 12 and radiant heater assembly 16 being affixed to strut 24, with strut 24 being pivotable on a pin 36 of support 8. In this regard, strut 24 is pivotable about a pivot axis 40 that extends through pin 36, and bed 12 and radiant heater assembly 16 thus are likewise pivotable in a fixed relation to one another about pivot axis 40 and pin 36. Bed 12 might be configured to allow movement only to about 20° with respect to horizontal, or another appropriate position, to limit the potential for the patient to roll off bed 12. Moreover, bed 12, strut 24, and radiant heater assembly 16 might be partially or fully dynamically balanced about pit 36 to enable a person of limited size and strength to pivot bed 12 and radiant heater assembly 16 about pivot axis 40.

Pin 36 is depicted in FIG. 1 as extending into the plane of the page of FIG. 1 and into base 20. It is understood that in other embodiments not expressly depicted herein, pin 36 may be otherwise positioned or may be covered or otherwise hidden from view, etc. In this regard, it is also understood that bed 12 and radiant heater assembly 16 will still be pivotable about pivot axis 40 in fixed relation to one another regardless of whether pin 36 is actually visible.

Figure 1A:
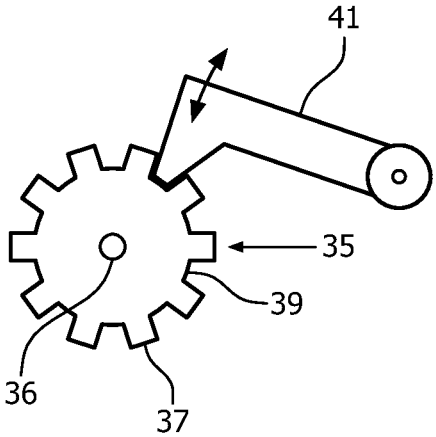
FIG. 1A is an exemplary depiction of a locking mechanism that can be incorporated into the improved bed apparatus of FIG. 1.

It is further understood that support 8 is likely to include a locking mechanism, any number of which can be easily envisioned by a person of ordinary skill in the relevant art. As is depicted in FIG. 1A, an exemplary locking system 35 might include a notched wheel 37 having a plurality of notches 39 that can each receive a portion of a pawl 41 therein. By way of example, pin 36 might be affixed to strut 24, and notched wheel might in turn be affixed to pin 36. In such a scenario, pawl 41 might be situated on base 20. The elements of locking system 35 can be otherwise arranged, and other types of locking systems may be employed without departing from the present concept. Locking mechanism 35 would enable strut 24 to be locked in a given position with respect to base 20. Such locking of strut 24 would have the effect of locking bed 12 and radiant heater assembly 16 in a particular position with respect to base 20. Other types of locking mechanisms might include frictional systems wherein a certain force is required to overcome a frictional lock in order to move bed 12 or might include electronic locking systems that employ magnetic forces to selectively limit movement of bed 12.

Figure 1B:
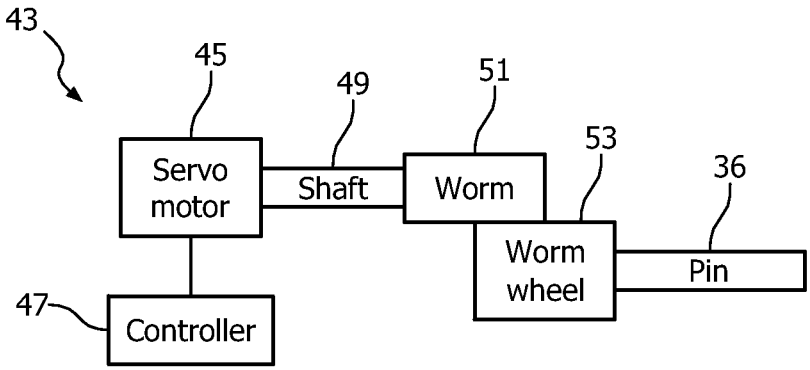
FIG. 1B is an exemplary depiction of a motorized adjustment mechanism that can be incorporated into the improved bed apparatus of FIG. 1.
Figure 1C:
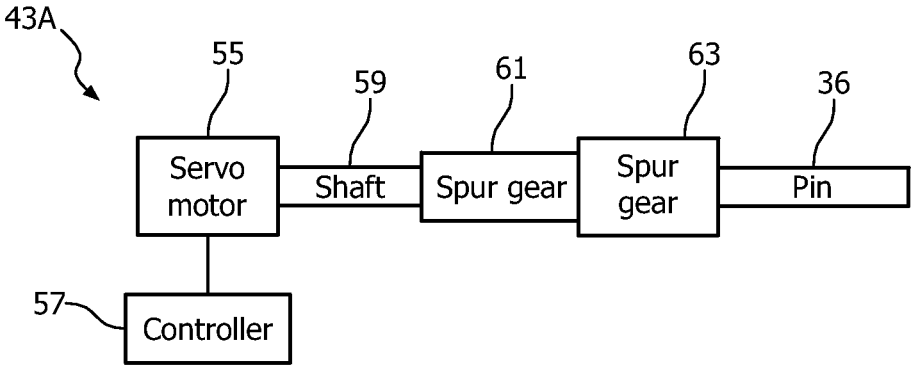
FIG. 1C is an exemplary depiction of another motorized adjustment mechanism that can be incorporated into the improved bed apparatus of FIG. 1.

It is also noted that an exemplary servomotor drive adjustment mechanism 43 as is depicted in FIG. 1B or an alternative exemplary servomotor drive adjustment mechanism 43A as is depicted in FIG. 1C could be employed with bed apparatus 4. Servomotor drive adjustment mechanism 43 might include a servo motor 45 that is operated by a controller 47 and is operatively connected with a shaft 49. Shaft 49 connects with a worm gear 51 which interfaces with a worm gear 53 that is connected with pin 36. Servomotor drive adjustment mechanism 43 thus can provide motorized adjustment of bed 12 among its plurality of bed positions along with contemporaneous movement of radiant heater assembly 16. Servomotor drive adjustment mechanism 43 would also effectively lock bed 12 and radiant heater assembly 16 in a given position until controller 47 is operated to move bed apparatus 4 to a different position. Servomotor drive adjustment mechanism 45 might operate in a similar fashion and might include a servo motor 55 that is operated by a controller 57 and is operatively connected with a shaft 59. Shaft 59 connects with a spur gear 61 which interfaces with another spur gear 63 that is connected with pin 36. In alternative embodiments, servo motors 45 and 55 and controllers 47 and 57 could be replaced with a hand crank.

Figure 1D:
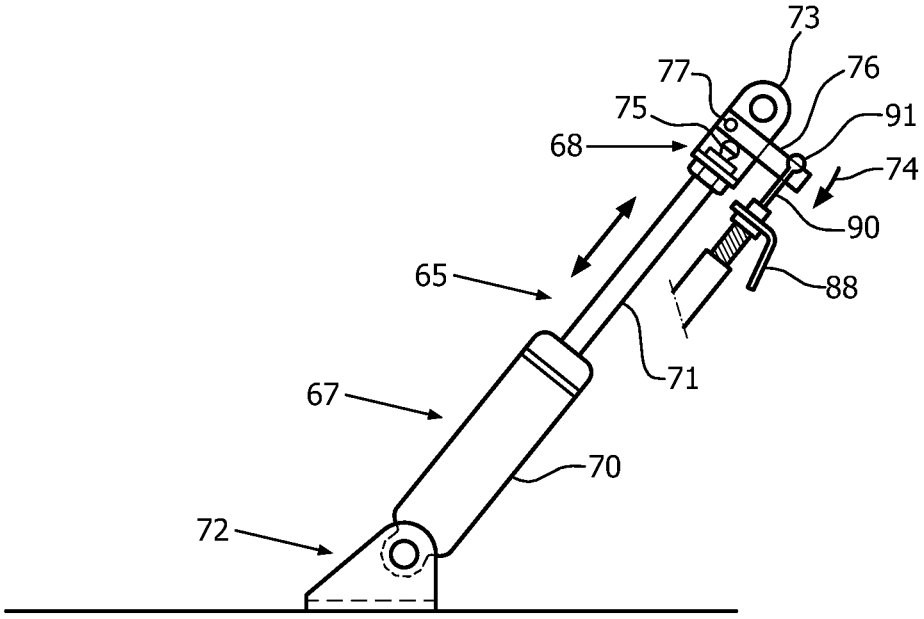
FIGS. 1D and 1E depict different portions of another exemplary locking mechanism that can be incorporated into the improved bed apparatus of FIG. 1.
Figure 1E:
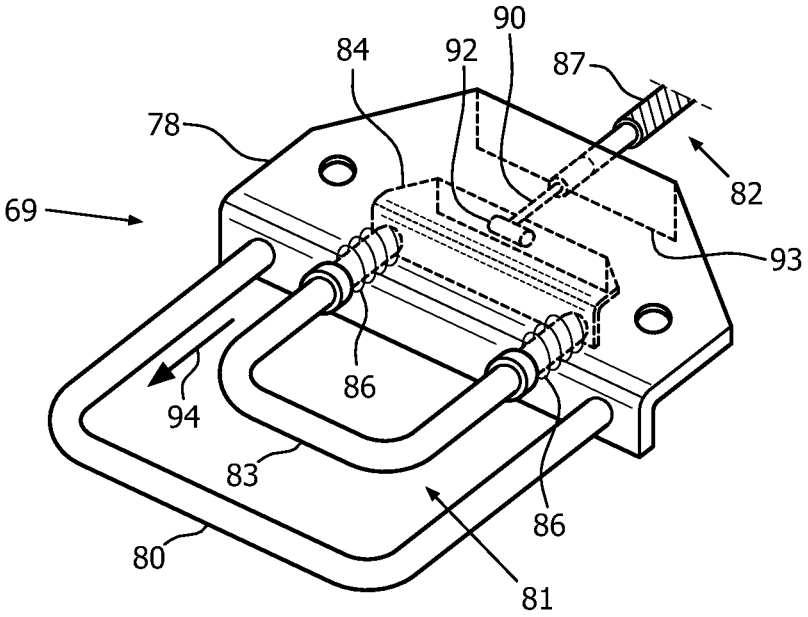
Figure 1F:
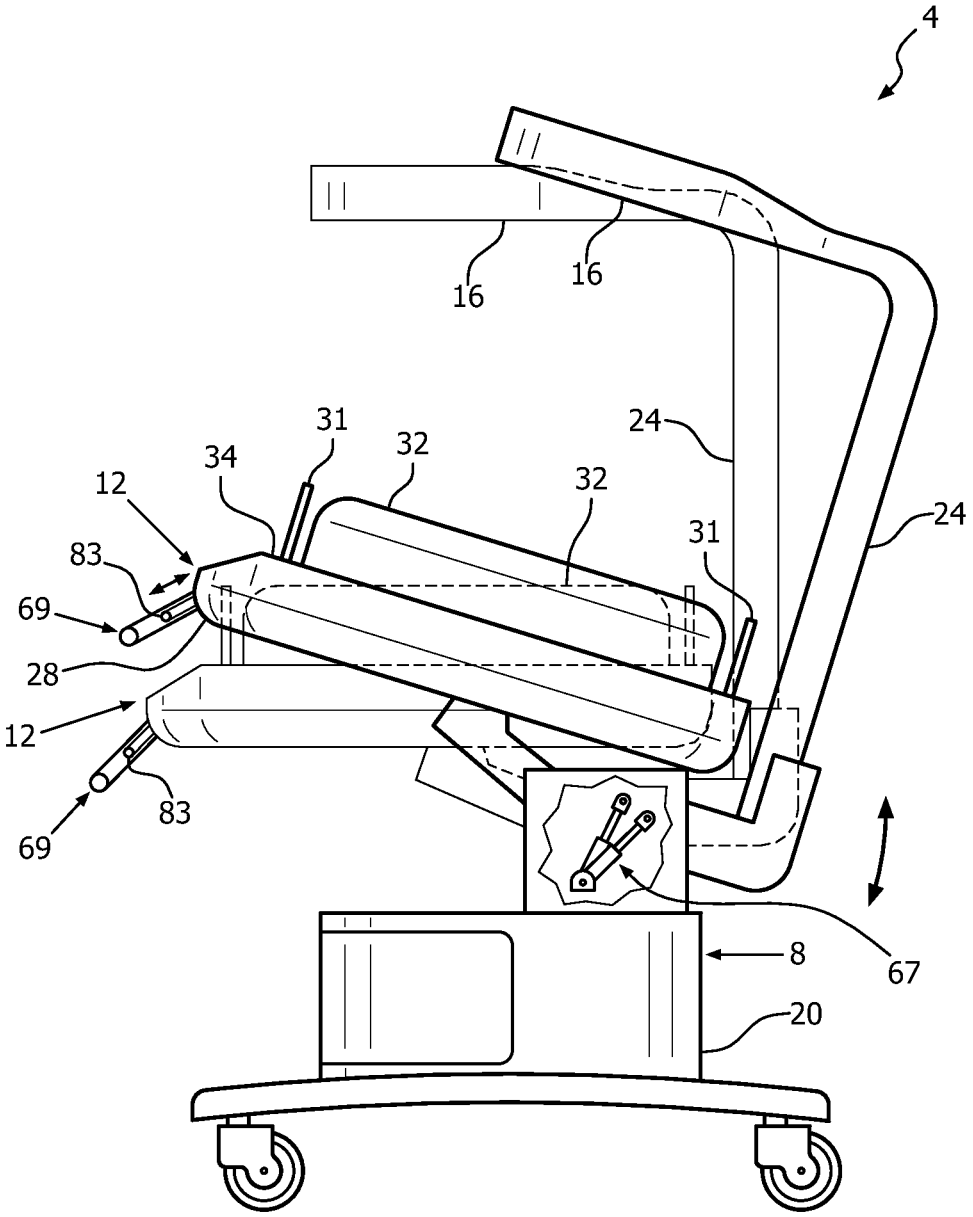
FIG. 1F depicts the improved bed apparatus of FIG. 1 partially cut away and having the locking mechanism of FIGS. 1D and 1E installed thereon.

FIGS. 1D-1F depict another exemplary locking mechanism 65 incorporated into the bed apparatus 4. More particularly, FIGS. 1D and 1E depict locking mechanism 65 as including a lockable gas spring system 67 (FIG. 1D) and an adjustment mechanism 69 (FIG. 1E), and FIG. 1F depicts bed apparatus 4 with locking mechanism 65 installed thereon.

As can be understood from FIG. 1D, the lockable gas spring system 67 includes a gas-pressurized cylinder 70 and a telescoping rod 71. A pressurized gas such as nitrogen or another appropriate gas that is situated within gas-pressurized cylinder 70 biases telescoping rod 71 in a direction generally away from gas-pressurized cylinder 70. Gas-pressurized cylinder 70 is connected with a bracket 72 to base 20, and telescoping rod 71 is connected with another bracket 73 to strut 24. As is understood in the relevant art, the pressurized gas within gas-pressurized cylinder 70 and the resultant biasing of telescoping rod 71 provides an additional lifting force to facilitate the pivoted lifting of strut 24 against gravity. That is, when strut 24 is pivoted in the clockwise direction from the perspective of FIG. 1F, telescoping rod 71 is pushed to strut 24 in a direction toward gas-pressurized cylinder 70 and further compresses the pressurized gas situated therein. The biasing of telescoping rod 71 by the pressurized gas provides the additional lifting force when pivoting strut 24 in the counter-clockwise direction from the perspective of FIG. 1F.

Lockable gas spring system 67 further includes a locking apparatus 68 that includes a telescoping plunger 75 and a lever 76 that pivots about an axle 77. When plunger and lever 76 are in the position depicted generally in FIG. 1D, interlocking structures within gas-pressurized cylinder 70 and telescoping rod 71 resist telescoping movement of telescoping rod 71 and thus lock strut 24 in a given position with respect to base 20. However, when lever 76 is caused to pivot about axle 77 in the direction indicated with the arrow 74, plunger 75 is depressed in a direction generally toward gas-pressurized cylinder 70 which causes the inter-locking structures to be released and to enable telescoping rod 71 to telescope with respect to gas-pressurized cylinder 70. In such a condition, strut 24 is pivotable with respect to base 20.

Lever 76 is caused to be pivoted in the direction of arrow 74 in the aforementioned fashion by actuation of adjustment mechanism 69. As can be understood from FIGS. 1D and 1E, adjustment mechanism 69 includes a mounting element 78 to which are connected a handle 80, a release apparatus 81, and a cable apparatus 82. Mounting element 78 typically is fastened using bolts or other fasteners to platform 28 in such a fashion that handle 80 is readily accessible, as is indicated in FIG. 1F. Handle 80 is stationary with respect to mounting element 78. However, release apparatus 81 is movable with respect to mounting element 78. More particularly, release apparatus 81 includes a grip 83 connected with a mount 84 and is biased via a pair of springs 86 in a direction generally away from handle 80.

Cable apparatus 82 includes a hollow sheath 87 mounted to a retention element 88 that is affixed to strut 24. Cable apparatus 82 also includes an elongated flexible cable 90 that is movable within the interior of sheath 87 and further includes a pair of lugs 90 and 92 affixed at opposite ends of cable 90. Cable apparatus 82 is in the exemplary form of a Bowden cable, although other types of motion-transferring structures can be employed without departing from the present concept.

As can be understood from FIGS. 1D and 1E, cable apparatus 82 functionally extends between lockable gas spring system 67 and release apparatus 81 in order to enable the plunger 75 to be depressed remotely from wherever adjustment mechanism 69 is positioned on platform 28. Retention element 88 at one end of sheath 87 retains that end of sheath 87 stationary with respect to strut 24. The opposite end of sheath 87 is affixed to a leg 93 of mounting element 78 in order to keep such opposite end of sheath 87 stationary with respect to mounting element 78 and release apparatus 81. Lug 91 is connected with lever 76, as can be seen at FIG. 1D, and lug 92 is connected with mount 84, as can be seen in FIG. 1E.

When grip 83 is pulled in the direction generally indicated at the arrow 94, motion from grip 83 is transferred via mount 84 to lug 92 and thereafter to cable 90, pulling cable 90 within and with respect to sheath 87 in a direction generally toward handle 80. Since the opposite ends of sheath 87 are affixed to leg 93 of mounting element 78 and to retention element 88 mounted to strut 24, such motion of cable 91 toward handle 80 results in pivoting of the lever 76 in the direction indicated at the arrow 74, which causes the plunger 75 to be depressed and to release the structures that lock the telescoping rod 71 with respect to the gas-pressurized cylinder 70. Strut 24 thus can be pivoted with respect to base 20.

When grip 83 is released, springs 86 bias grip 83 and mount 84 in a direction opposite the arrow 94, thus causing lever 76 to pivot in a direction opposite the arrow 74 to lock telescoping rod 71 and gas-pressurized cylinder 70 into position with respect to one another, thus locking the position of the strut 24 and thus the platform 28 in a given position with respect to base 20.

Figure 1G:
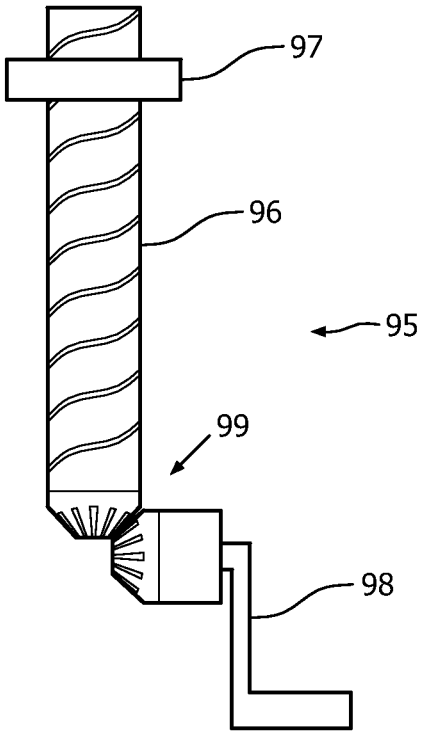
FIG. 1G depicts a further exemplary locking mechanism that can be incorporated into the improved bed apparatus of FIG. 1.

Another exemplary locking mechanism 95 is indicated generally in FIG. 1G. Locking mechanism 95 can be incorporated into bed apparatus 4 in place of locking mechanism 65.

Locking mechanism 95 includes a lead screw 96 that is pivotably disposed on base 20 and a follower 97 that is threadably cooperable with lead screw 96 and which is connected to strut 24. Locking mechanism 95 further includes a handle 98 and a set of bevel gears 99 interposed between handle 98 and lead screw 96.

As can be understood from FIG. 1G, rotating of the handle 98 causes cooperative operation of bevel gears 99 to achieve rotation of lead screw 96 and resultant translation of follower 97 along the longitudinal extent of lead screw 96. Since follower 97 is connected with strut 24, such movement of the handle 98 causes pivoting of strut 24 with respect to base 20. It thus can be understood that locking mechanism 94 serves as an adjustment system to pivot strut 24 and thus platform 28 with respect to base 20.

Locking mechanism 95 further serves as a retention system to retain strut 24 in a given position with respect to base 20. More particularly, the threads of lead screw 96 are at an angle of less than 45° (forty-five degrees) which serves as a locking mechanism. That is, the relatively shallow angle of threads on lead screw 96 resists forces (such as gravitational forces) on follower 97 from rotating lead screw 96. It is understood that lead screw 96 can be threaded at an angle other than 45° without departing from the present concept so long as the forces that can reasonably be expected to be experienced by follower 97 are insufficient to rotate lead screw 96, which will desirably avoid unintended pivoting of strut 24 with respect to base 20.

It thus can be understood from FIG. 1 that bed 12 is movable about pivot axis 40 among a plurality of bed positions, with two such bed positions being depicted. Likewise, radiant heater assembly 16 is movable about pivot axis 40 among a plurality of heater positions, with two such heater positions being depicted in FIG. 1. Since strut 24 extends fixedly between platform 28 and radiant heater assembly 16, movement of bed 12 about pivot axis 40 among the various bed positions correspondingly results in contemporaneous movement of radiant heater assembly 16 among the plurality of heater positions.

As can further be understood from FIG. 1, radiant heater assembly 16 is of an elongated configuration and remains substantially parallel with platform surface 34, and thus with any mattress that may be disposed thereon, in all of the various bed positions and corresponding heater positions. Radiant heater assembly 16 can be any of a wide variety of heater apparatuses and typically will include a radiant heating element of a type that is generally understood in the relevant art. By causing radiant heater assembly 16 and bed 12 to move simultaneously about pivot axis 40, and to thereby stay in a parallel relationship, uniformity of irradiance of bed 12 and thus the patient thereon is greatly promoted, which is advantageous.

It is understood that numerous variations of the described and depicted concept are possible. For instance, pin 36 and pivot axis are depicted as being situated underneath bed 12, meaning near an end of strut 24 and between bed 12 and a floor upon which bed apparatus 4 is disposed. In alternate embodiments, base 20 could have an upwardly extending mounting element which would enable pin 36 to be connected with base 20 at about the midpoint of strut 24. This would allow the lateral travel of radiant heater assembly 16 that is depicted in FIG. 1 to be relatively lessened by being divided among lateral movements of both bed 12 and radiant heater assembly 16 about pivot axis 40, which would be situated at a vertically higher position than is depicted from the perspective of FIG. 1. Other variations can be envisioned.

Figure 2:
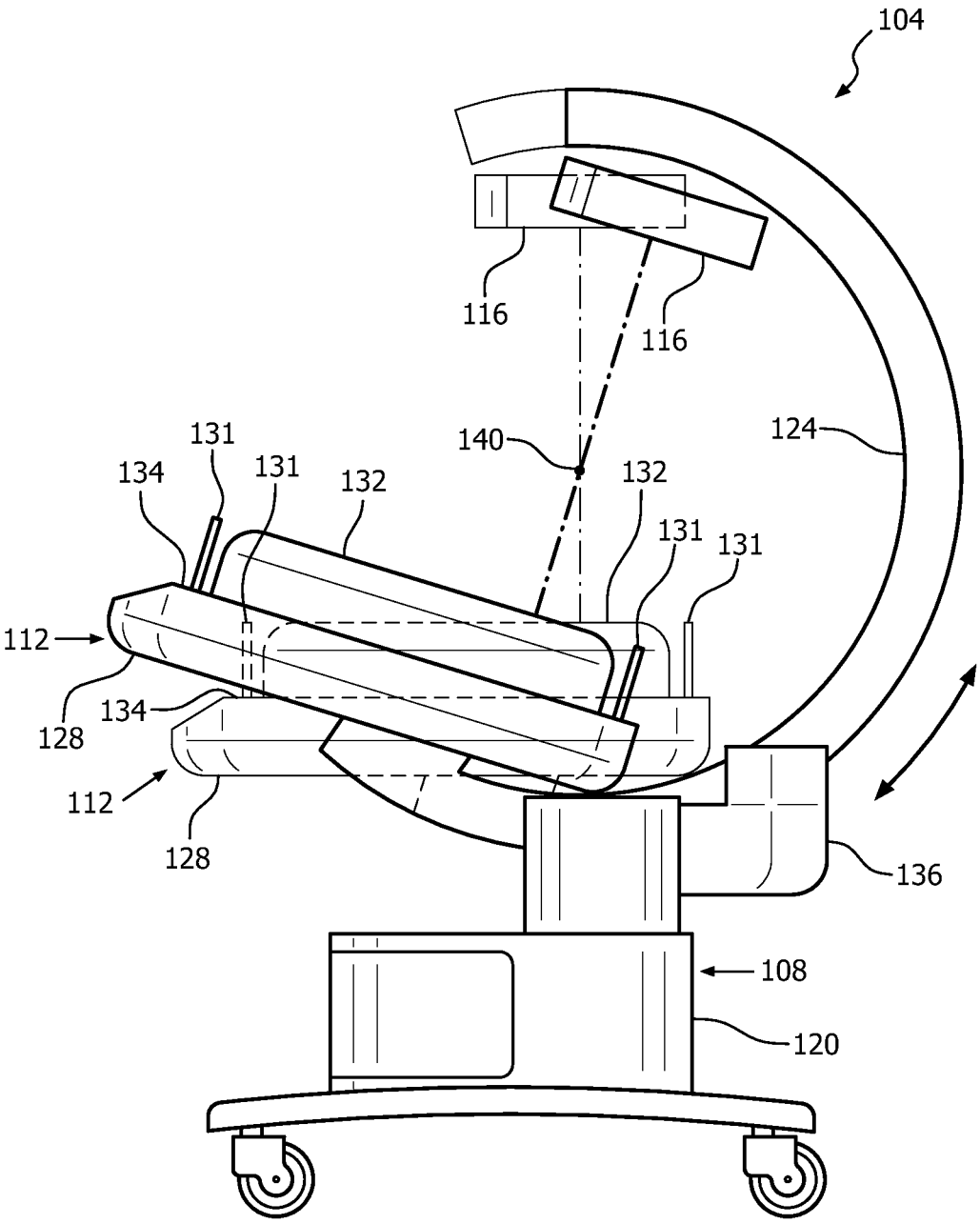
FIG. 2 is a diagrammatic view of an improved bed apparatus in accordance with another embodiment of the disclosed and claimed concept.

An improved bed apparatus 104 in accordance with another embodiment of the disclosed and claimed concept is depicted generally in FIG. 2. Bed apparatus 104 includes a support 108 upon which are disposed a bed 112 and a radiant heater assembly 116. Support 108 includes a base 120 and a strut 124, with strut 124 being of an arcuate, partial annular configuration having a fixed radius and having bed 112 and radiant heater assembly 116 affixed thereto.

As can further be seen in FIG. 2, base 120 includes a sliding connection 136 within which strut 124 is slidably disposed. Sliding connection 136 includes structures that are described below in connection with FIG. 2A and which enable strut 124 to remain disposed on base 120 yet to slide with respect thereto.

It can be understood that strut 124, and thus bed 112 and radiant heater assembly 116, pivot about a pivot axis 140 that is disposed between bed 112 and radiant heater assembly 116. That is, pivot axis 140 is disposed between and spaced from support 108, bed 112, and radiant heater assembly 116. Bed 112 includes a platform 134 having a substantially planar platform surface 134, a pair of side guards 131, and a pair of end guards 132 disposed on platform surface 134. Pivot axis 140 in the exemplary embodiment of FIG. 2 extends into the plane of the page of FIG. 2.

As with bed apparatus 4, bed apparatus 104 is movable to enable a plurality of bed positions of bed 112 and a plurality of heater positions of radiant heater assembly 116, with bed 112 and radiant heater assembly 116 moving contemporaneously about pivot axis 140 to cause radiant heater assembly 116 to remain parallel and aligned with bed 112 and platform surface 134 regardless of the particular position of bed 112 with respect to base 120. That is, the fixed relationship between bed 112 and radiant heater assembly 116 by both being affixed to strut 124 enables bed 112 and radiant heater assembly 116 to move in concert and to cause the relative position therebetween to remain constant. Such constant relative position promotes uniformity of irradiance of a patient disposed on bed 112, which is desirable.

Figure 2A:
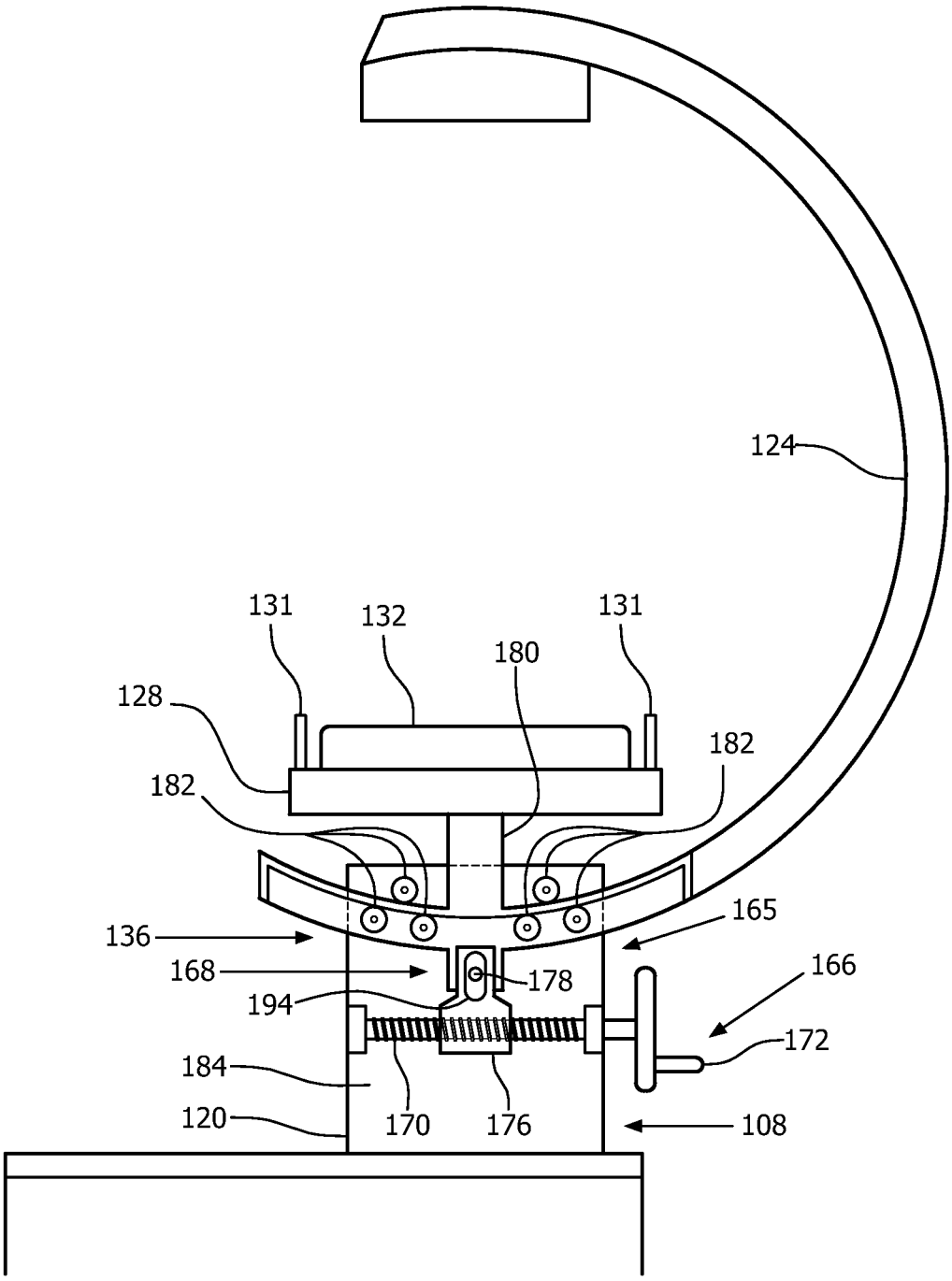
FIG. 2A is a depiction of a portion of the improved bed apparatus of FIG. 2 having an exemplary locking mechanism incorporated therein.

As can be understood from FIG. 2A, sliding connection 136 includes a locking mechanism 165 that can be said to include a lead screw mechanism 166 and a movement mechanism 168. It is to be understood that FIG. 2A depicts merely one exemplary embodiment of sliding connection 136, and that variations can be employed without departing from the main concept.

Lead screw mechanism 166 is disposed on base 120 and includes a lead screw 170, a handle 172, a moving block 176, and a drive pin 178. Lead screw 170 is rotatably disposed on base 120 and can be cranked by rotating handle 172. Moving block 176 is threadably cooperable with lead screw 170 such that rotation of lead screw 170 results in translation of moving block 176 along the longitudinal extent of lead screw 170. As will be described in greater detail below, drive pin 178 is situated in a slot 194 formed in moving block 176.

Figure 2B:
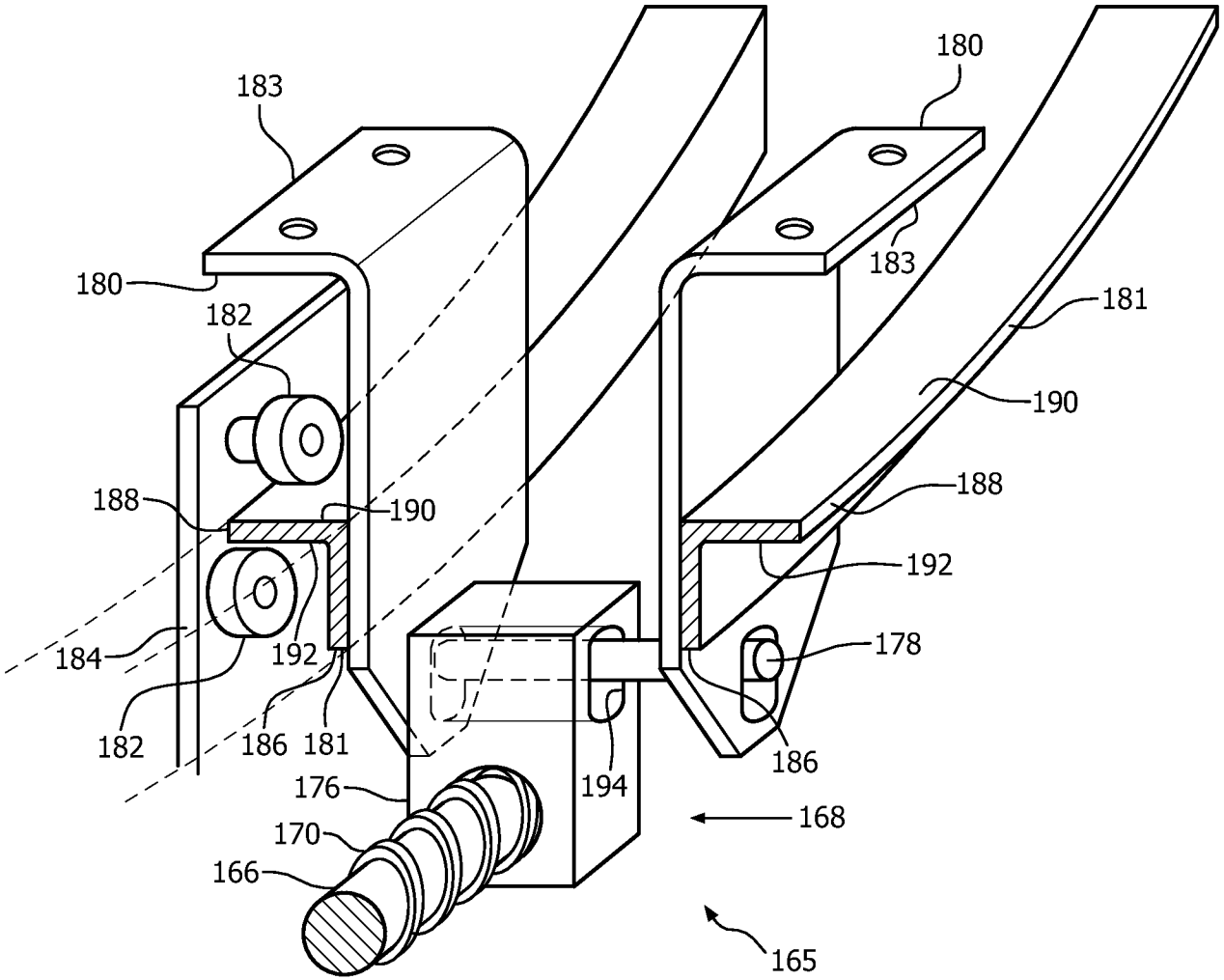
FIG. 2B is a depiction of a portion of the locking mechanism of FIG. 2A.

Drive pin 178 is also mounted to a pair of mounting brackets 180 that are depicted in FIG. 2A and that are depicted in greater detail in FIG. 2B. More particularly, strut 124 can be seen in FIG. 2B as including a pair of angle elements 181, with each mounting bracket 180 being affixed to an associated angle element 181. Angle elements 181 and mounting brackets 180 can be affixed together in any of a variety of fashions including, by way of example, welding, adhering, fastening, co-forming, and the like without limitation. Platform 128 is mounted to outwardly-protruding wings 183 of mounting brackets 180.

Movement mechanism 168 can be said to include a set of rollers 182 mounted to a pair of plates 184 of base 120. More particularly, each plate 184 has, in the exemplary embodiment depicted herein, six of the rollers 182 rotatably disposed thereon. Only two of the rollers 182 from among the twelve rollers 182 of the movement mechanism 168 are depicted in FIG. 2B for purposes of clarity.

As can be understood from FIGS. 2A and 2B, each angle element 181 of strut 124 can be said to include a first leg 186 and a second leg 188 that are connected together. Mounting brackets 180 can be said to be generally affixed to first legs 186, whereas second legs 188 generally interact with rollers 182. It is noted that in alternate embodiments first legs 186 may also interact with certain rollers. As can be understood from FIG. 2A, the six rollers 182 of each plate 184 are arranged such that two of the six rollers 182 rollably interact with an upper surface 192 of second leg 188, with the other four of the six rollers 182 rollably interacting with a lower surface 192 of the second leg 188, with the terms "upper" and "lower" being from the perspective of FIG. 2A.

Since handle 172 is directly coupled to lead screw 170, rotation of handle 172 causes corresponding rotation of lead screw 170 and threaded translation of moving block 176. Moving block 176 thus carries pin 178 therewith along the longitudinal extent of lead screw 170. Since drive pin 178 is received in holes formed in mounting brackets 180, translation of moving block 176 and thus drive pin 178 causes corresponding translation of mounting brackets 180 therewith, albeit along an arcuate path since mounting brackets 180 are affixed to strut 124 which, itself, moves about pivot axis 140. In this regard, and as can be understood from FIG. 2B, slot 194 is elongated in what can be understood from FIG. 2A as being in the vertical direction to enable such movement of the mounting brackets 180 about an arcuate path while moving block 176 moves along a linear path. That is, drive pin 178 moves vertically upward within slot 194 whenever moving block 176 is moved to either of the longitudinal extremes of lead screw 170.

While it can be seen that locking mechanism 165 serves as a mechanism by which strut 124 and platform 128 can be moved about pivot axis 140, it can further be understood that locking mechanism 165 further can lock strut 124 in a given position with respect to base 120 by configuring the thread of lead screw 170 to have a desirably shallow angle that will resist the forces (such as gravitational forces) in strut 124 from being transferred via moving block 176 and causing unintended rotation of lead screw 170. Rather, the thread of lead screw 170 is at an angle of 45° (forty-five degrees) or less to resist such unintended movement of lead screw 170 by strut 124. It is understood, however, that the thread of lead screw 170 can be at other angles appropriate to the application without departing from the present concept.

Figure 3:
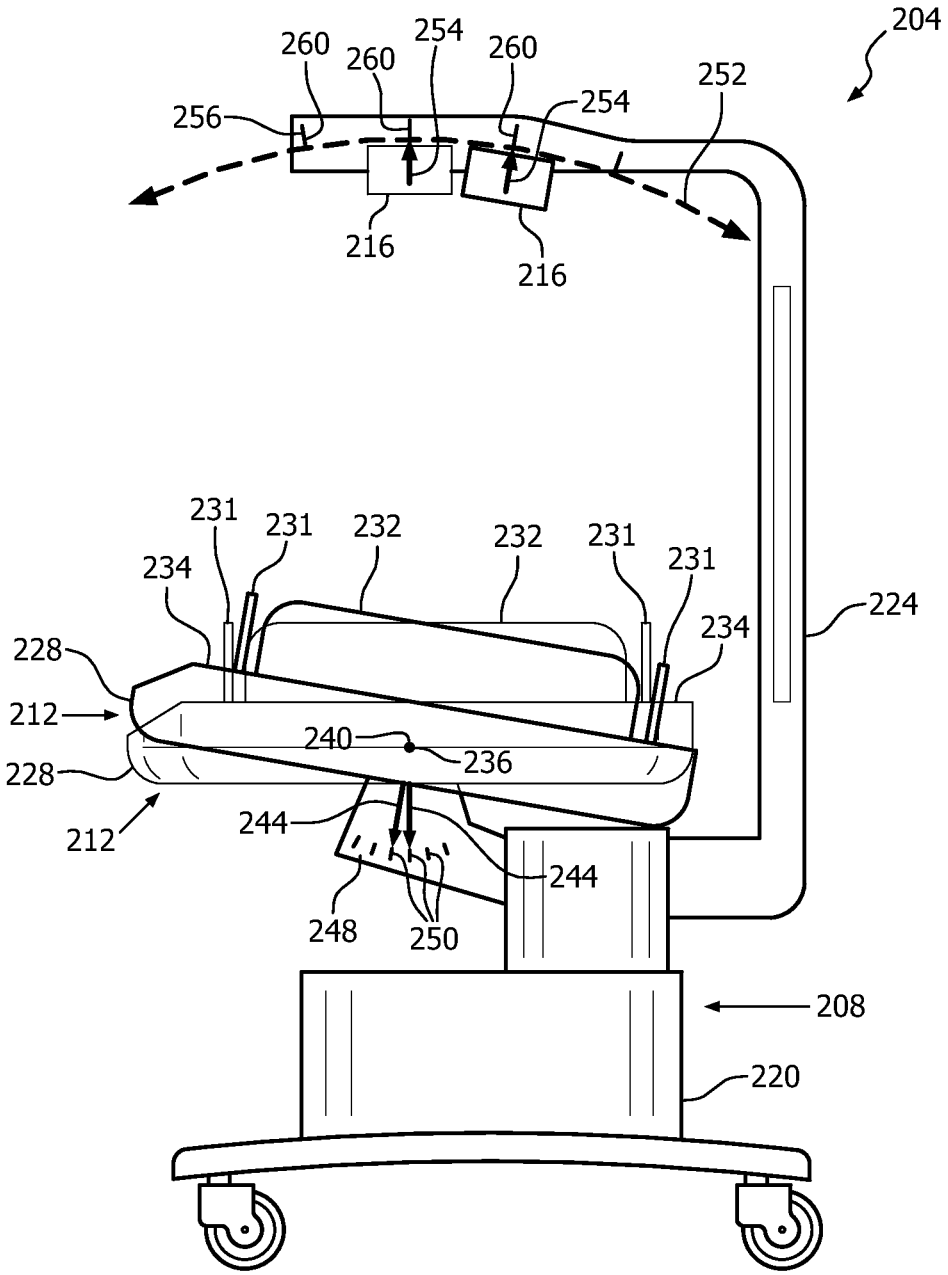
FIG. 3 is a diagrammatic view of an improved bed apparatus in accordance with another embodiment of the disclosed and claimed concept.

An improved bed apparatus 204 in accordance with a third embodiment of the disclosed and claimed concept is depicted generally in FIG. 3. Bed apparatus 204 includes a support 208 upon which are disposed a bed 212 and a radiant heater assembly 216.

Support 208 includes a base 220 and a strut 224. While bed 212 and radiant heater assembly 216 are movable about a pivot axis 240, it can be understood that bed apparatus 204 is different from bed apparatus 4 and bed apparatus 104 in that radiant assembly 216 and bed 212 are independent. That is, bed 212 and radiant heater assembly 216 are not both affixed to strut 224. However, bed 212 and radiant heater assembly 216 are both movable about pivot axis 240, and scales are provided in order to enable manual alignment between bed 212 and radiant heater assembly 216 to enable them to be oriented substantially parallel with one another.

Bed 212 includes a platform 224 having a substantially planar platform surface 234, a pair of side guards 231, and a pair of end guards 232. Support 208 further includes a pin 236 disposed thereon about which platform 228 is pivotable. Pivot axis 240 thus extends through pin 236 and is depicted in FIG. 3 as extending into the plane of the page of FIG. 3. As can be understood from FIG. 3, therefore, bed 212 is movable about pin 236 and about pivot axis 240 among a plurality of bed positions.

In this regard, FIG. 3 depicts in a schematic fashion a bed indicator 244 that extends from platform 228 in a direction generally toward base 220 and further depicts in a schematic fashion a bed scale 248 formed on base 220. Bed indicator 244 is connected with platform 228 and moves therewith and points toward bed scale 248. More particularly, bed scale 248 includes a plurality of graduations 250 situated at different angular positions about pivot axis 240. When bed 212 is moved to a particular bed position, bed indicator 244 points to a particular location among graduations 250 of bed scale 248, thus indicating to a nurse, technician, or other individual the particular position of bed 212 with respect to support 208.

FIG. 3 further depicts at the numeral 252 a path of movement of radiant heater assembly 216 with respect to strut 224. While radiant heater assembly 216 is movable among a plurality of heater positions, it is understood that such movement is independent of bed 212. It can be seen from FIG. 3, however, that path of movement 252 is a circular arc having pivot axis 240 at its center. That is, radiant heater assembly 216 moves on path of movement 252 about pivot axis 240, as does bed 212. It is understood that radiant heater assembly 216 potentially can move through a slot formed in strut 224, can move along a track situated on strut 224, or can otherwise be movably disposed on strut 224 in any of a wide variety of fashions that can be contemplated by a person of ordinary skill in the relevant art.

As can further be understood from FIG. 3, a heater indicator 254 extends from radiant heater assembly 216, and a heater scale 256 is disposed on strut 224 and having a plurality of graduations 260. As radiant heater assembly 216 is manually moved among the plurality of heater positions, heater indicator 254 will point to a position indicated among the plurality of graduations 260 of heater scale 256. In this regard, it can be seen that graduations 260 are spaced along path of movement 252 and are each oriented generally toward pivot axis 240, which further indicates the fashion in which radiant heater assembly 216 is movable about pivot axis 240.

It can be understood that by providing bed indicator 244 and heater indicator 254, the position of radiant heater assembly 216 along path of movement 252 can be matched with the rotational position of bed 212, and vice versa, about pin 236 and pivot axis 240. In the embodiment depicted generally in FIG. 3, bed 212 and radiant heater assembly 216 are movable independent of one another and each has a locking mechanism that is not expressly depicted herein but that is well within the skill of a person having ordinary skill in the relevant art.

While strut 224 is affixed to base 220 in the embodiment of FIG. 3, and while bed 212 and radiant heater 216 are both disposed on strut 224, it is understood that bed 212 and radiant heater assembly 216 are both independently movable with respect to support 208 and, in particular, with respect to strut 224. Bed indicator 244 and bed scale 248 enable the specific bed position of bed 212 with respect to support 208 to be ascertained, and heater indicator 254 and heater scale 256 likewise enable the specific heater position of radiant heater assembly 216 with respect to support 218 to be ascertained. The movability of bed 212 and radiant heater assembly 216 thus enables one or the other or both to be positioned such that radiant heater assembly 216 remains substantially parallel with platform surface 234 to promote uniformity of irradiance of bed 212 and likewise of a patient situated on bed 212.

It is understood that the use of bed indicator 244, bed scale 248, heater indicator 254, and heater scale 256 to enable manual alignment of bed 212 and radiant heater assembly 216 is merely an example of the way in which the position of each with respect to support 208 can be indicated to a nurse, technician, or other person. Numerous other embodiments of the idea can be conceived without departing from the main concept.

It is also understood that other types of indicators and indication systems may be employed without departing from the present concept. For instance, in an alternate embodiment heater indicator 254 and/or heater scale 256 might be replaced with or supplemented by a visual indicator that may be projected from the vicinity of radiant heater assembly 216 onto platform surface 234. Such a visual indicator could be in the form of a grid that may be disposed centrally on platform surface 234 when alignment has been achieved between bed 212 and radiant heater assembly 216, or that might have some other type of indicia that alignment has been achieved. Alternatively, platform surface 234 could be pre-marked with some type of an indicator, and a beam of light projected from the vicinity of radiant heater assembly 216 would be coincident with the pre-marked indicator when alignment has been achieved. Other variations will be apparent.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A bed apparatus comprising:

a support;

a bed disposed on the support and movable about a pivot axis among a plurality of bed positions; and a radiant heater assembly movable about the pivot axis among a plurality of heater positions, the radiant heater assembly in a first heater position being oriented to face toward the bed in a first bed position, the radiant heater assembly in a second heater position being oriented to face toward the bed in a second bed position; wherein the support comprises a strut that extends between and above the bed and below the radiant heater assembly and wherein the strut pivots about the pivot axis.

2. The bed apparatus of claim 1 wherein at least one of the bed and the support comprises a first indicator structured to indicate a position of the bed, the radiant heater assembly comprising a second indicator structured to indicate a position of the radiant heater assembly, the radiant heater assembly being oriented to face toward the bed when the first indicator and the second indicator indicate the same position.

3. The bed apparatus of claim 2 wherein the radiant heater assembly is manually movable among the plurality of heater positions.

4. The bed apparatus of claim 1 wherein the bed has a surface that is generally planar and wherein the radiant heater assembly is elongated, the radiant heater assembly in the first heater position being oriented substantially parallel with the surface in the first bed position, the radiant heater assembly in the second heater position being oriented substantially parallel with the surface in the second bed position.

5. The bed apparatus of claim 1 wherein the bed and the radiant heater assembly are affixed to the strut.

6. The bed apparatus of claim 1 wherein the support further comprises a base, the strut being movably disposed on the base.

7. The bed apparatus of claim 6 wherein the strut is pivotably disposed on the base, the pivot axis extending through the base.

8. The bed apparatus of claim 6 wherein at least a portion of the strut is of an arcuate configuration, the at least portion of the strut being slidably disposed on the base, the pivot axis being the spaced from the base.

9. The bed apparatus of claim 8 wherein the pivot axis is situated between the base and the radiant heater assembly.

10. The bed apparatus of claim 1 wherein the support further comprises a locking mechanism connected with the strut.

11. The bed apparatus of claim 10 wherein the locking mechanism comprises a lead screw.

12. The bed apparatus of claim 10 wherein the locking mechanism comprises a gas-pressurized structure to bias the strut.

* * * * *